US006054802A

United States Patent [19]

Ohira et al.

[11] Patent Number: 6,054,802

[45] Date of Patent: Apr. 25, 2000

[54] CATHODE FOR ELECTRONIC TUBE

[75] Inventors: Takuya Ohira; Masato Saito; Hiroyuki Teramoto, all of Tokyo, Japan

[73] Assignee: Mitsubishi Denki Kabushiki Kaisha, Tokyo, Japan

[21] Appl. No.: 09/029,032

[22] PCT Filed: Jun. 10, 1997

[86] PCT No.: PCT/JP97/01976

§ 371 Date: Feb. 20, 1998

§ 102(e) Date: Feb. 20, 1998

[87] PCT Pub. No.: WO97/49108

PCT Pub. Date: Dec. 24, 1997

[30] Foreign Application Priority Data

Jun. 20, 1996 [JP] Japan ..... 8-159387

[51] Int. Cl.[7] ..... H01J 1/00

[52] U.S. Cl. ..... 313/326; 313/337; 313/270; 313/346 R

[58] Field of Search ..... 313/326, 337, 313/346 R, 346 DC, 270, 446

[56] References Cited

FOREIGN PATENT DOCUMENTS 3-257735 11/1991 Japan .

*Primary Examiner*—Vip Patel
*Assistant Examiner*—Mariceli Santiago

[57] ABSTRACT

Problems with a conventional cathode for electronic tubes arose because metals composing the substrate were subjected to heat deformation, resulting in a relatively lage drift of cutoff voltage. The present invention diminishes the heat deformation of the substrate to obtain a cathode with a small drift of cutoff voltage. Particularly, heat expansion coefficients can be made uniform while metals in the metal layer are prevented from diffusing into the substrate. This is done by incorporating the same metals present in the metal layer into the metals composing the substrate, thereby supressing deformation of the substrate.

4 Claims, 6 Drawing Sheets

CATHODE FOR ELECTRONIC TUBE

This application is the national phase under 35 U.S.C. §371 of prior PCT International Application No. PCT/JP 97/01976 which has an International filing date of Jun. 10, 1997 which designated the United States of America, the entire contents of which are hereby incorporated by reference.

TECHNICAL FIELD

This invention relates to a method for improving the performance of an electronic tube, more specifically to a method for suppressing drift of cut-off voltage during operation.

BACKGROUND ART

FIG. 6 shows a conventional cathode for an electronic tube used in cathode ray tubes in televisions and image pickup tubes as disclosed in Japanese Patent Laid-open No. 3-257735.

In FIG. 6, 1 is a substrate mainly composed of nickel (Ni) containing a small amount of reduction elements such as silicon (Si) and magnesium (Mg), 2 is a cathode sleeve composed of chromium and the like, 13 is a metal layer mainly composed of at least one or more of tungsten, molybdenum, tantalum, chromium, silicon and magnesium, and 5 is a layer of an electron-emitting material deposited on the metal layer 13, containing at least barium in addition to alkali earth metal oxides 11 which include strontium and/or calcium as main components and also containing 0.1 to 20% by weight of rare earth metal oxides 12 such as scandium oxide, and 3 is a heater disposed within the substrate 1 that discharges thermoelectrons from the electron-emitting material 5 by heating.

Due to the construction of the conventional cathode for electronic tubes described above, when a metal layer of tungsten is formed on the substrate, tungsten in the metal layer diffuses into the substrate mainly composed of nickel by heat aging and emission aging during the CRT production process or by the heat generated during its operation. While this diffusion layer usually forms as a Ni—W layer with a thickness of 10 to 20 microns after 10,000 operating hours, the substrate is thermally deformed into a convex or concave shape depending on the thickness of the tungusten metal layer at the initial stage of life of the cathode because the thermal expansion coefficients of the layer of the electron emitting material of the substrate and the layer close to a heater differ, or because layers having different lattice constants are separately formed. A problem arose due to this deformation in that the distance between the first grid (electrode) and the surface of the cathode fluctuates, resulting in a drift of the cutoff voltage. This drift in the cutoff voltage also caused a problem in that after a prolonged operating time, the brightness of the screen greatly fluctuates or, in the case of color cathode ray tubes, the hue is greatly fluctuates.

The object of the present invention is to solve the foregoing problem by providing a method for reducing the thermal deformation of the substrate to obtain a cathode for electronic tubes with a small drift of the cutoff voltage.

DISCLOSURE OF INVENTION

Accordingly, the first aspect of the present invention provides a cathode for electronic tubes in which, a metal layer containing a substance different from the reduction agent and mainly composed of at least one or more of tungsten, molybdenum, tantalum, chromium, silicone and magnesium is formed on a substrate comprising nickel as a main component and also containing at least one reduction agent, a layer of electron emitting material mainly composed of alkali earth metal oxides containing at least barium is formed on this metal layer, wherein the substrate contains the same metals as those mainly constituting said metal layer.

Accordingly, the heat deformation caused by the difference of thermal expansion between the substrate and metals is made extremely small and drift of cutoff voltage is suppressed because the substrate contains the same metals as those composing the metal layer, thereby enabling the substrate to be used in cathode ray tubes with high brightness and high resolution.

The second aspect of the present invention provides a cathode for electronic tubes in which, a metal layer containing a substance different from the reduction agent and mainly composed of at least one or more of tungsten, molybdenum, tantalum, chromium, silicone and magnesium is formed on a substrate comprising nickel as a main component and also containing at least one reduction agent, a layer of electron emitting material mainly composed of alkali earth metal oxides containing at least barium is formed on this metal layer wherein, in the cathode for electronic tubes with the substrate containing the same metals as those mainly composing the metal layer, the thickness of the metal layer is 0.01 to 1.5 $\mu$m and the metal layer contains 0.001 to 0.5% by weight of the same metals as those contained in the substrate.

Accordingly, the heat deformation is made extremely small and drift of cutoff voltage is suppressed because the thickness of the metal layer is 0.01 to 1.5 $\mu$m and the metal layer contains 0.001 to 0.5% by weight of the same metals as those contained in the substrate, thereby enabling the substrate to be used in cathode ray tubes with high brightness and high resolution.

The third aspect provides a cathode for electronic tubes in which, a metal layer containing a substance different from the reductive agent and mainly composed of at least one or more of tungsten, molybdenum, tantalum, chromium, silicone and magnesium is formed on a substrate comprising nickel as a main component and also containing at least one reduction agent, a layer of electron emitting material mainly composed of alkali earth metal oxides containing at least barium is formed on this metal layer wherein, in the cathode for electronic tubes with the substrate containing the same metals as those mainly composing the metal layer, and the weight ratio of the same metals as those contained in the substrate and the weight of the metal layer is 0.04 to 100.

Accordingly, the heat deformation is made extremely small and drift of cutoff voltage is suppressed because the weight ratio of the same metals as those in the metal layer contained in the substrate to the metal layer is 0.04 to 100. In addition, a substrate which may be used in cathode ray tubes with high brightness and high resolution can be obtained because a stable emission current is provided.

BEST MODE FOR CARRYING OUT THE INVENTION

Example 1

Figure 1:
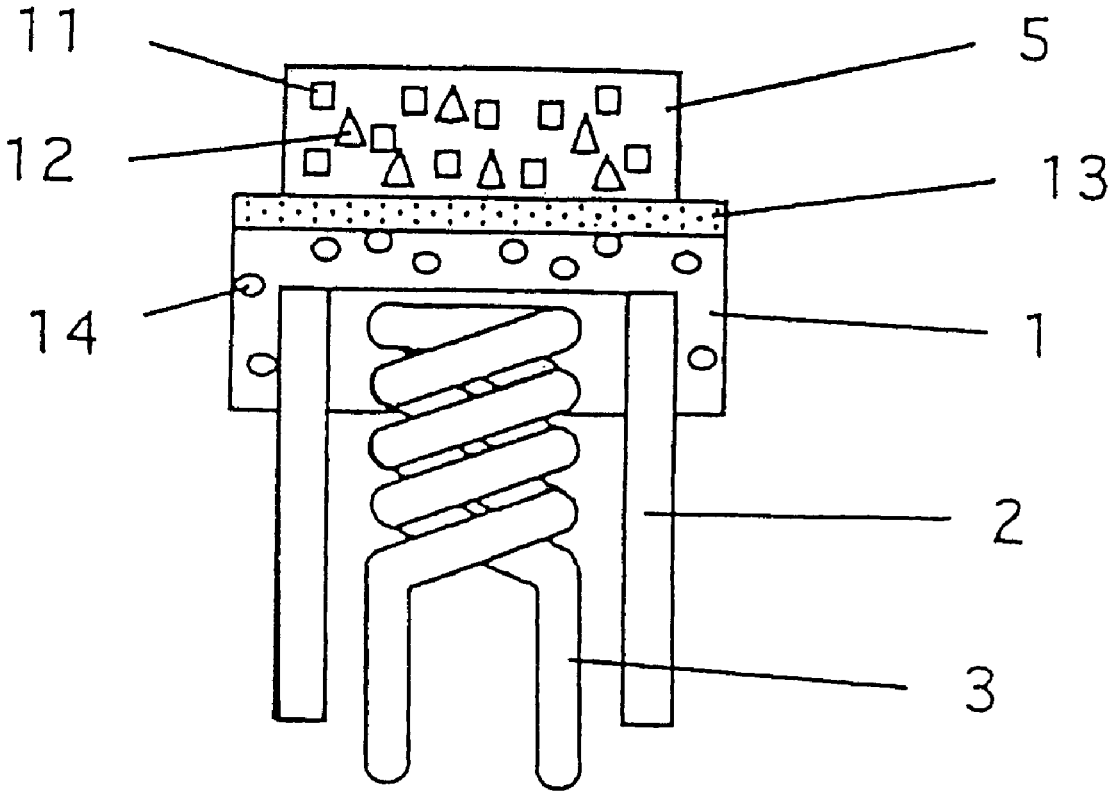
FIG. 1 is an enlarged cross section of the cathode for electronic tubes according to the Example 1 of the present invention.

The examples of the present invention will be described referring to the drawings. FIG. 1 is a cross section of the cathode for electronic tubes according to Example 1 of the present invention. In the figure, 2 is a cathode sleeve 13 is a metal layer of tungsten formed on the substrate 1, 5 is a layer of a electron emitting material deposited on the metal layer 13, containing at least barium in addition to alkali earth metal oxides 11 including strontium and/or calcium as main components and containing 0.01 to 25% by weight of rare earth oxides such as scandium oxide 12 and yttrium oxide, 14 is tungsten incorporated into the substrate and 3 is a heater disposed within the substrate 1 that discharges thermoelectrons from the electron-emitting material 5 by heating.

Figure 2:
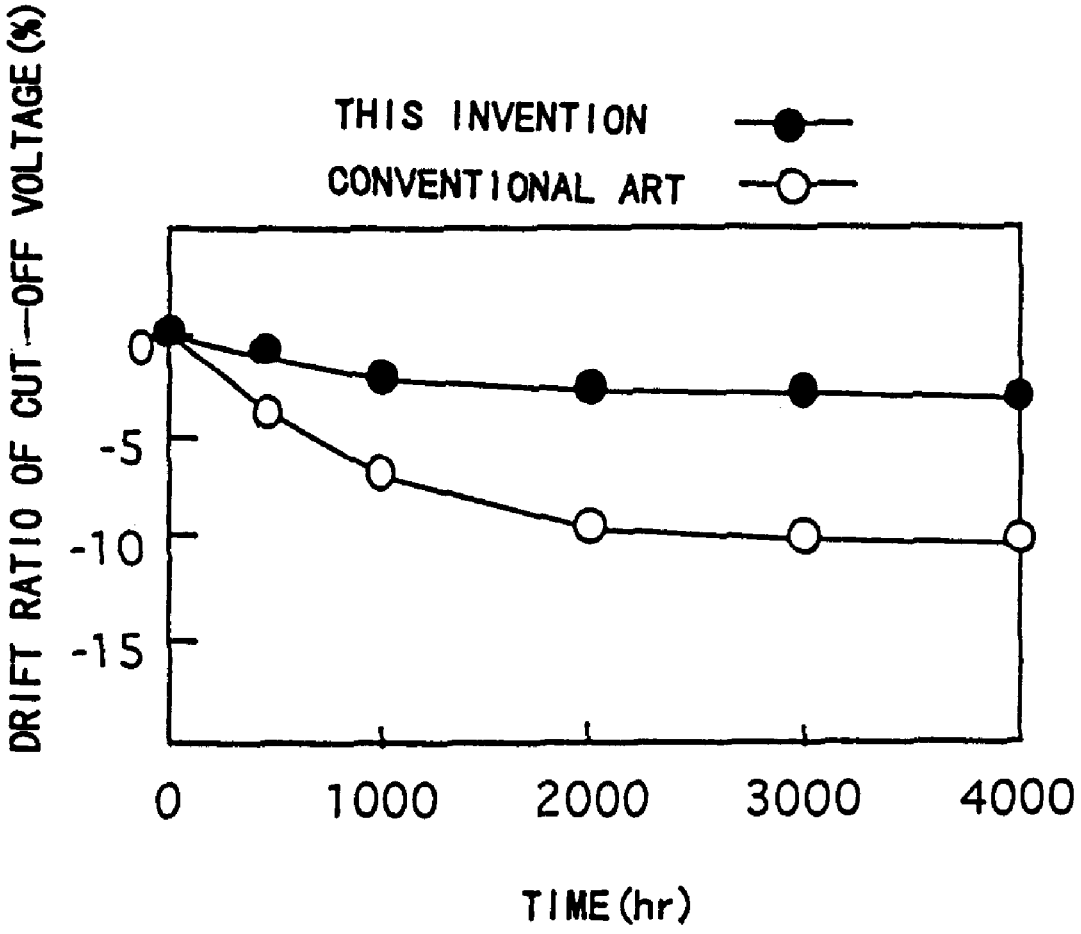
FIG. 2 is a graph indicating the characteristic of the cathode for electronic tubes according to the Example 1 of the present invention.

FIG. 2 is a graph showing a comparison between the drifts of the cutoff voltage of a CRT which was completed via a conventional evacuation means after equipping a conventional television with the cathode for electronic tubes according to the present invention and the drifts of the cutoff voltage of a CRT equipped with a conventional cathode for electronic tubes.

The metal layer 13 used herein was subjected to a heat treatment at 1000° C. in a hydrogen atmosphere after forming a tungsten film with a thickness of 1.5 $\mu$m. Alkali earth metal oxides containing 7% by weight of scandium oxide was used as the electron emitting material 5. Tungsten contained in a quantity of 0.5% by weight in the substrate was used as the metal 14. As indicated in FIG. 2, it was shown that the cathode according to the present invention has a smaller drift of the cutoff voltage than a conventional CRT.

Figure 3:
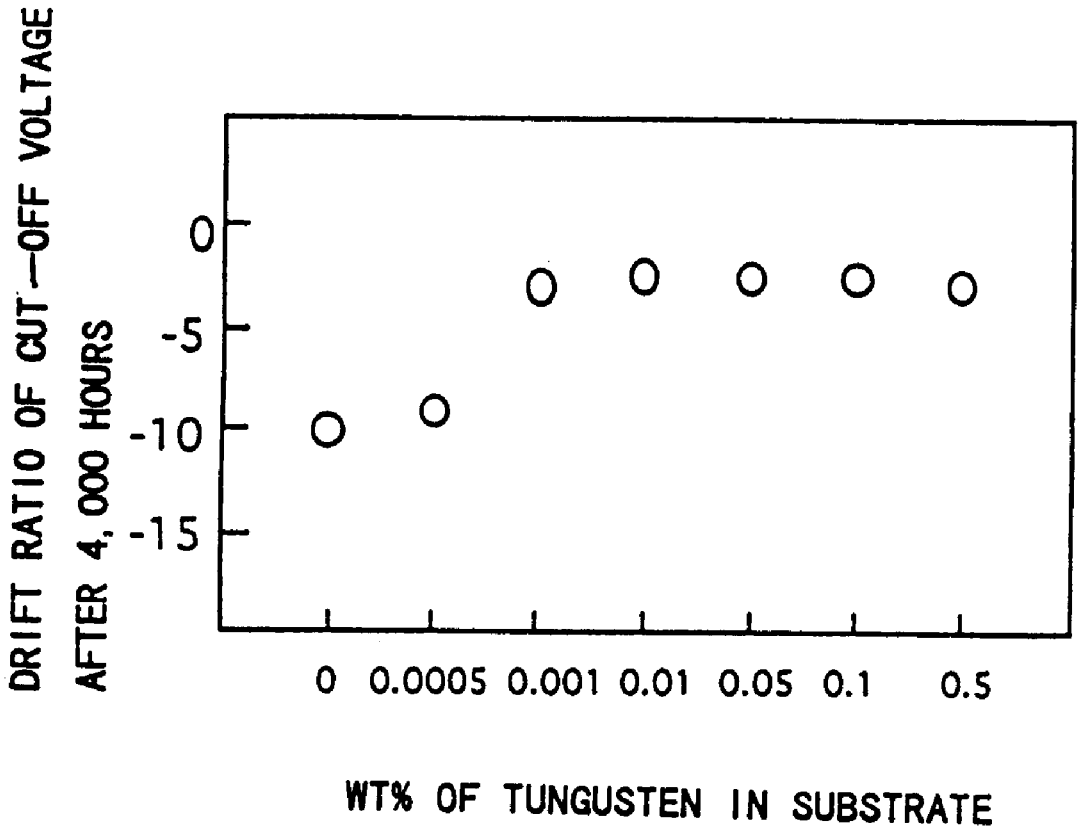
FIG. 3 is a graph indicating the characteristic of the cathode for electronic tubes according to the Example 1 of the present invention.

FIG. 3 is a graph showing the relationship between the drift ratio of the cutoff voltage for a CRT after 4000 operating hours and the proportion (in % by weight) of the metal in the substrate that was completed by a conventional evacuating means after equipping a conventional television with the cathode for electronic tubes according to the present invention.

The metal layer 13 used herein was subjected to heat treatment at 1000° C. in a hydrogen atmosphere after forming a tungsten film with a thickness of 1.5 $\mu$m. Alkali earth metal oxides containing 7% by weight of scandium oxide was used as the electron emitting material 5. Tungsten contained in a quantity of 0 to 0.5% by weight in the substrate was used as the metal 14. As indicated in FIG. 3, it was shown that the cathode with 0.001 to 0.5% by weight of the metal 14 in the substrate has a smaller drift in the cutoff voltage than that with 0.001% by weight or less of the metal in the substrate.

The following may be considered the reason why the cathode for electronic tubes according to this example has a very small drift of the cutoff voltage: In the conventional examples, as discussed hitherto, tungsten in the metal layer diffuses into the substrate mainly composed of nickel to separately form layers with a different thermal expansion coefficients or different lattice constants, thereby thermally deforming the substrate into a convex or concave shape depending on the thickness of the metal layer of tungsten. In the present invention, on the other hand, the rapid diffusion of tungsten in the metal layer into the substrate mainly composed of nickel can be prevented because the substrate contains the same metals in the metal layer. This allows the thermal expansion coefficient of the substrate to be very close to that of the metal layer to prevent sudden stress from being generated on the surface of the substrate, the cathode is thereby able to exhibit the characteristic of a very small drift of the cutoff voltage during its life.

When the content of tungsten incorporated into the substrate is less than 0.001% by weight, on the other hand, the difference between the thermal expansion coefficient of the substrate and that of the metal layer becomes so large that the drift of cutoff voltage during its life will be large. When the tungsten content in the substrate is greater than 0.5% by weight, the production yield of the substrate metals are decreased so that production becomes impractical.

Example 2

Figure 4:
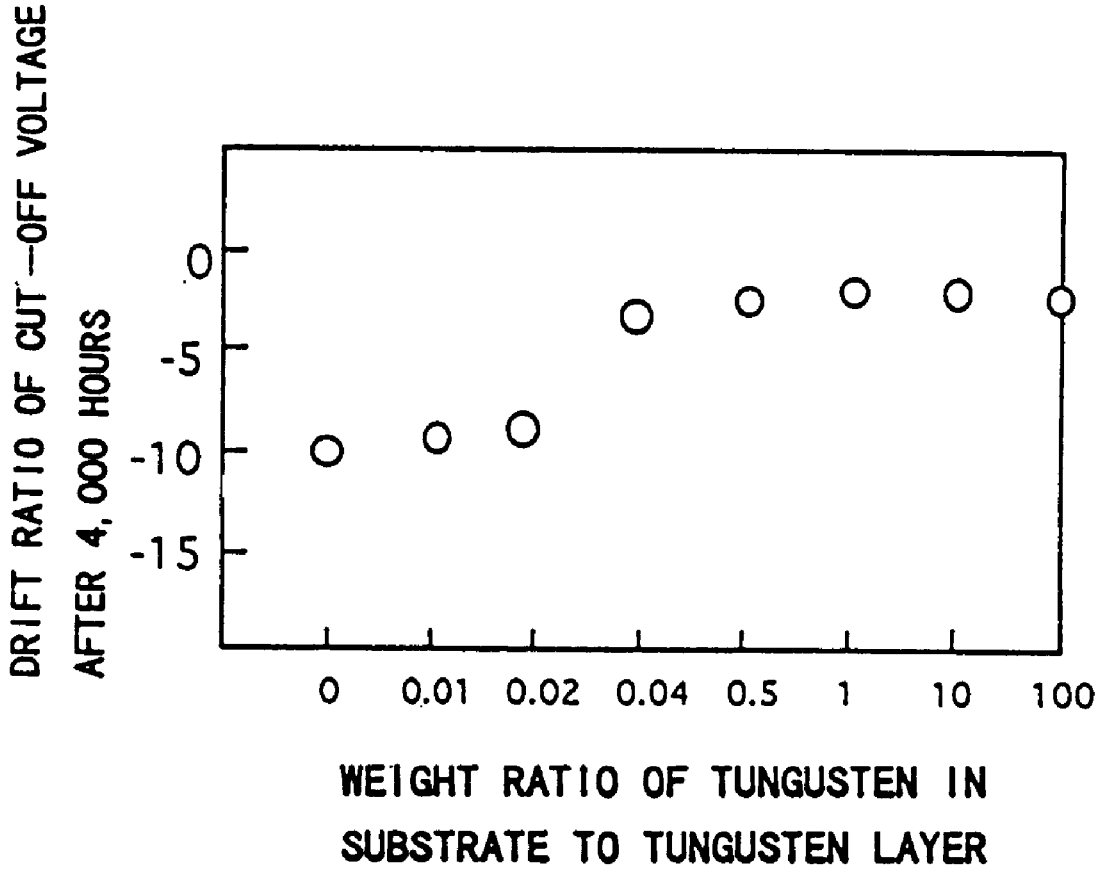
FIG. 4 is a graph indicating the characteristic of the cathode for electronic tubes according to the Example 2 of the present invention.

FIG. 4 shows the relationship between the drift ratio of cutoff voltage of a CRT after 4000 operating hours and the ratio of the weight of the metal in the substrate to the weight of the metal layer on the substrate completed via a conventional evacuation means after equipping a conventional television with the cathode for electronic tubes according to the present invention.

The metal layer 13 as used herein was subjected to heat treatment at 1000° C. in a hydrogen atmosphere after forming a tungsten film with a thickness of 0.01 $\mu$m. Alkali earth metal oxides containing 7% by weight of scandium oxide was used as the electron emitting material 5. The content of the metal 14 in the substrate 1 may be determined from the ratio of the weight of the substrate to the weight of the metal layer. Tungsten is used as the metal 14, and is contained in the substrate in a ratio of the weight of the metal 14 to the weight of the metal layer 13 of 0 to 150. As indicated in FIG. 4, it was shown that the drift ratio of cutoff voltage is smaller when the weight ratio is 0.04 to 100 than that when the ratio is less than 0.04. It can be understood that, when the weight ratio is less than 0.04, the difference of the thermal expansion coefficients of the substrate and metal layer becomes very large, resulting in a large drift of the cutoff voltage during the life of the cathode.

Figure 5:
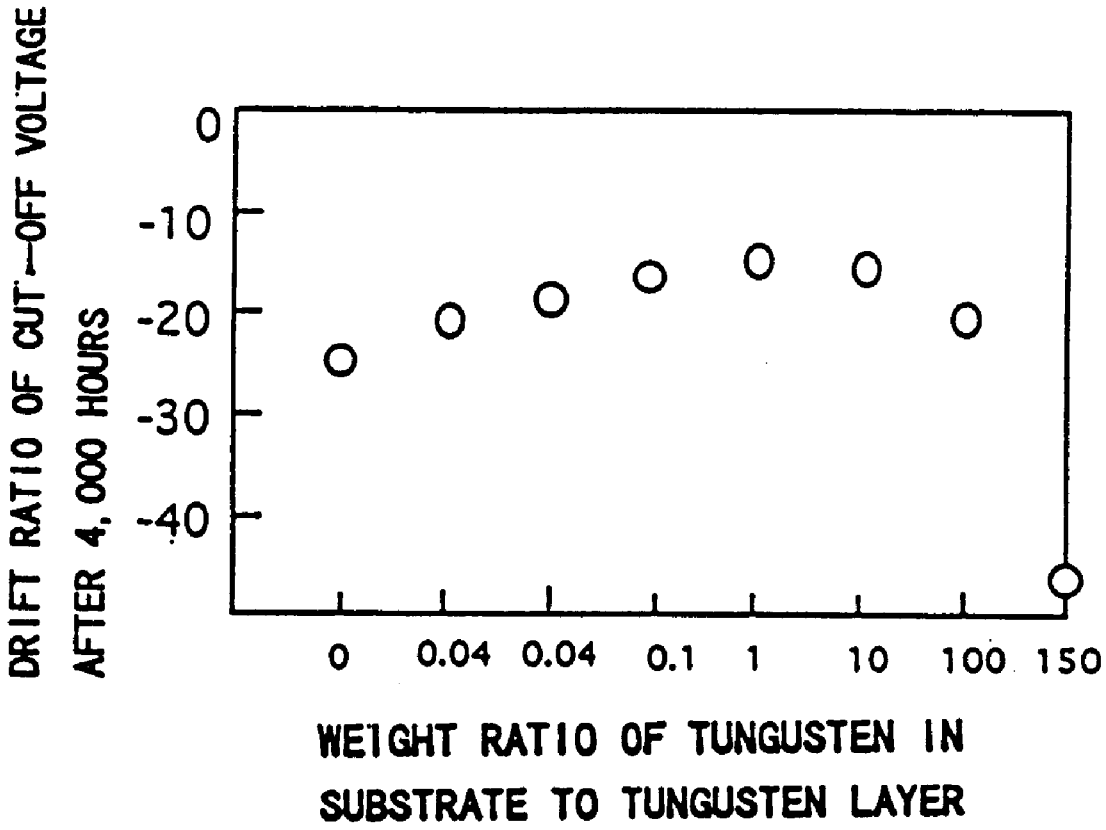
FIG. 5 is a graph indicating the characteristic of the cathode for electronic tubes according to the Example 2 of the present invention.
Figure 6:
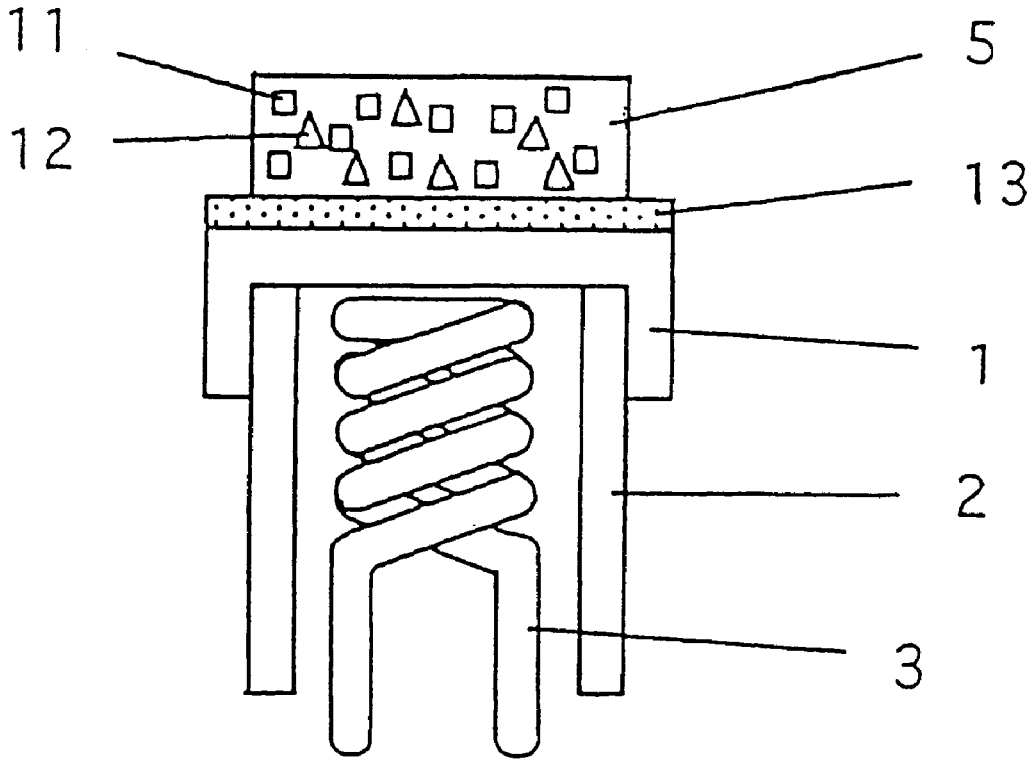
PRIOR ART FIG. 6
FIG. 6 is an enlarged cross section of the conventional cathode for electronic tubes.

FIG. 5 shows a relationship between the reduction of emission current of a CRT after 4,000 operating hours and the ratio of the weight of the metal in the substrate to the weight of the metal layer completed via a conventional evacuation means after equipping a conventional television with the cathode for electronic tubes according to the present invention.

The metal layer 13 used herein was subjected to heat treatment at 1000° C. in a hydrogen atmosphere after forming a tungsten film with a thickness of 0.01 $\mu$m. Alkali earth metal oxides containing 7% by weight of scandium oxide was used as the electron emitting material 5. The content of the metal 14 in the substrate 1 may be determined from the ratio of the weight of the substrate to the weight of the metal layer 14. Tungsten was used as the metal 14, and was is contained in the substrate in a ratio of the weight of the metal 14 to the weight of the metal layer 13 of 0 to 150. As indicated in FIG. 5, it was shown that the reduction of emission current is smaller when the weight ratio is 0.04 to 100 than that when the ratio is larger than 100.

In foregoing Example 1 and Example 2, the same effect as in Example 1 described above can be displayed provided that the thickness of the metal layer 13 is in the range of 0.01 to 1.5 $\mu$m and the proportion of the metal 14 included in the substrate is in the range of 0.001 to 0.5% by weight. However, a content larger than 0.5% it is not practical since the production yield of the metal for the substrate is decreased, whereas when the content is less than 0.001% by weight, heat deformation of the substrate can not be suppressed. In Example 2 described above, on the other hand, the content of the metal 14 contained in the substrate is much smaller than 0.001% by weight. The same effect described above can be also exhibited in Example 2 provided that the ratio of the weight of the metal 14 to the weight of the metal layer 13 is in the range of 0.04 to 100. However, when the ratio is larger than 100, reduction of emission current becomes large, whereas heat expansion of the substrate can not be suppressed when the ratio is smaller than 0.04.

In Example 1 and Example 2 described above, the cathode may be produced by a method for forming a tungsten layer on a substrate mainly composed of nickel that is incorporated with a reducing agent and tungsten; that is, for example, a substrate mainly composed of nickel is produced by a mechanical processing such as rolling after adding a reducing agent and tungsten, followed by forming a tungsten film thereon by a sputtering or vacuum deposition method.

Otherwise, the method may comprise the steps of adding a reducing agent, subjecting a substrate mainly composed of nickel and a tungsten layers to heat treatment after forming the tungsten layer on the substrate mainly composed of nickel, and forming another tungsten layer after allowing the former tungsten layer to diffuse into the substrate.

Although the examples in which tungsten was used for the metal layer were described in Example 1 and Example 2 above, the metal layer may be mainly composed of at least one metal selected from tungsten, molybdenum, tantalum, chromium, silicon and magnesium provided that the metal is different from the reducing agent to be added to the substrate.

INDUSTRIAL APPLICABILITY

As disclosed herein, the cathode for electronic tubes according to the present invention is applicable to a cathode ray tube for television display, a variety of image pickup tubes, transmitting tubes and discharge tubes.

What is claimed is:

1. A cathode for electron tubes, comprising:

a substrate including nickel as a main component and further including at least one kind of reduction agent;

a metal layer formed on said substrate and containing a substance different from said at least one kind of reduction agent, said metal layer being mainly composed of at least one or more of tungsten, molybdenum, tantalum, chromium, silicon and magnesium, said substrate containing the same metals as those mainly constituting said metal layer; and a layer of electron emitting material formed on said metal layer, said electron emitting substance being mainly composed of alkali earth metal oxides including at least barium.

2. A cathode for electronic tubes according to claim 1, wherein the thickness of the metal layer is 0.01 to 1.5 $\mu$m and the metal layer contains 0.001 to 0.5% by weight of the same metals as those contained in the substrate.

3. A cathode for electronic tubes according to claim 1, wherein the ratio between the weight of the same metals as those contained in the substrate and the weight of said metal layer is 0.04 to 100.

4. A cathode for electronic tubes according to claim 2, wherein the weight ratio between the weight of the same metals as those contained in the substrate and the weight of said metal layer is 0.04 to 100.

* * * * *